US006578646B2

(12) United States Patent
Juujärvi et al.

(10) Patent No.: US 6,578,646 B2
(45) Date of Patent: Jun. 17, 2003

(54) METHOD AND ARRANGEMENT FOR REDUCING DUST-RELATED PROBLEMS IN ROCK DRILLING

(75) Inventors: Kari Juujärvi, Nokia (FI); Tapani Sormunen, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/210,088

(22) Filed: Aug. 2, 2002

(65) Prior Publication Data

US 2003/0024740 A1 Feb. 6, 2003

Related U.S. Application Data

(63) Continuation of application No. PCT/FI01/00096, filed on Feb. 1, 2001.

(30) Foreign Application Priority Data

Feb. 4, 2000 (FI) ..... 20000240

(51) Int. Cl.[7] ..... E21B 21/06
(52) U.S. Cl. ..... 175/66; 175/206
(58) Field of Search ..... 175/66, 206, 68, 175/69, 213, 212, 207

(56) References Cited

U.S. PATENT DOCUMENTS

| | | | | |
|---|---|---|---|---|
| 3,642,075 A | * | 2/1972 | Wills | 173/23 |
| 3,968,845 A | * | 7/1976 | Chaffin | 175/60 |
| 4,316,514 A | | 2/1982 | Jysky | |
| 4,390,284 A | | 6/1983 | Hyde et al. | |
| 4,406,330 A | * | 9/1983 | Jysky | 175/66 |
| 5,158,583 A | | 10/1992 | Bodin et al. | |
| 5,320,188 A | | 6/1994 | England | |
| 5,535,836 A | * | 7/1996 | Cagianut et al. | 175/213 |
| 5,875,858 A | * | 3/1999 | Brady | 175/68 |
| 6,106,733 A | * | 8/2000 | Wood | 210/774 |

FOREIGN PATENT DOCUMENTS

| | | |
|---|---|---|
| DE | 914 722 | 7/1954 |
| DE | 38 05 221 A1 | 8/1989 |
| FI | 810 499 | 8/1982 |
| GB | 823 800 | 11/1959 |
| GB | 2 197 595 A | 5/1988 |
| SE | 393 156 | 5/1977 |
| SE | 398 254 | 12/1977 |
| SE | 9803846-6 | 5/2000 |

OTHER PUBLICATIONS

International Search report., No. PCT/FI01/00096.

* cited by examiner

*Primary Examiner*—Frank Tsay
(74) *Attorney, Agent, or Firm*—Burns, Doane, Swecker & Mathis, L.L.P.

(57) ABSTRACT

In a method and arrangement for reducing dust-related problems in rock drilling, air and liquid mist is supplied into a drilling hole to moisten the dust that comes off the drilling hole. The air and moistened dust exiting from the drilling hole are led to a dust separator, dust portions that collect into the dust separator being removed therefrom at suitable intervals. When dust is to be removed from the dust separator's filter, liquid is supplied to the portion below the filter in a mist-like form or as small droplets in connection with the dust removal to moisten the dust which then falls out of the lower end of the dust separator.

13 Claims, 2 Drawing Sheets

METHOD AND ARRANGEMENT FOR REDUCING DUST-RELATED PROBLEMS IN ROCK DRILLING

This application is a Continuation of International Application PCT/FI01/00096 filed Feb. 1, 2001 which designated the U.S. and was published under PCT Article 21(2) in English.

BACKGROUND AND SUMMARY

This application claims priority under 35 U.S.C. §119 to FI 20000240, filed in Finland on Feb. 4, 2000, the entire content of which is hereby incorporated by reference. The present invention relates to a method for reducing dust-related problems in rock drilling, in which method air and liquid mist is supplied into a drilling hole to moisten the dust that comes off the drilling hole, the air and moistened dust exiting from the drilling hole being led to a dust separator for separating the dust from the air by leading the air through at least one filter, dust portions that collect into the dust separator being removed therefrom at suitable intervals.

The invention further relates to an arrangement for reducing dust-related problems in rock drilling, the arrangement comprising means for supplying flushing air and liquid into a drilling hole, suction means for sucking air containing stone dust and exiting from the drilling hole, a dust separator for separating the stone dust from the air, means for removing the accumulated dust from the dust separator and a liquid container for storing the liquid to be used for moistening the dust.

Rock drilling creates stone dust which is harmful and complicates working. Various means are therefore used in an attempt to prevent dust from being produced. One solution is to use water as a flushing means in the drilling to bind the dust and take it out of the hole. In a situation where water for some reason cannot be used, the dust has to be removed from the drilling hole with air. For reasons of occupational safety, among others, in such cases efforts are made to collect the dust so that there would be no stone dust left in the air at the drilling site. A typical solution for dust collection is to arrange a suction nozzle meant for the opening of the drilling hole around the drill rod, a hose being provided from the nozzle to the dust separator where the stone dust is separated from air that is led through filters. Stone dust that accumulates into the filters must be removed therefrom at suitable intervals to prevent the filters from being blocked. When there is no drilling going on, the stone dust is allowed to fall from the dust separator onto the ground for example by applying a compressed air pulse. Typically this takes place for example when the drilling of the hole has been completed.

There are drawbacks also in this solution because when the dust is allowed to fall from the dust separator onto the ground, dust is again created. In an attempt to prevent this, some kind of a dust-binding liquid is supplied together with air into the drilling hole to moisten the dust and to produce material that contains dust particles that stick together and therefore cause less dust. However, in practice this is not sufficient. In principle it would be possible to increase the amount of moistening liquid supplied, but that might block the dust-collecting equipment. Moreover, in a situation where an external water supply is not available, the equipment would have to provided with a large water tank, or water, or some other liquid, would have to be constantly brought to the site to allow this arrangement to be implemented.

It is an object of the present invention to provide a method and arrangement that allow dust to be bound into a more solid state, which in turn allows dust formation in connection with rock drilling to be reduced better than before without large amounts of liquid or large volume tanks being needed for handling the liquid. The method of the invention includes, when dust is to be removed, supplying liquid in a mist-like form or as small droplets substantially only in connection with the dust removal to the dust separator's lower portion below the filters so that the dust portion falling out of the lower end of the dust separator is sufficiently moist. The arrangement of the invention includes means for supplying liquid into the lower portion of the dust separator for moistening the dust that has accumulated into the dust separator when the dust is being removed from the dust separator.

During the emptying of the dust separator, liquid is supplied into its lower portion in the form of mist or extremely small droplets so that the dust falling from the dust separator onto the ground becomes moist and thereby the dust exiting from the dust separator is not dry and does not spread into the environment. Preferably that the liquid supplied into the lower portion of the dust separator during the emptying contains water and a biologically rapidly degradable material that acts in a glue-like manner and/or reduces the surface tension of water, such as a lignin-based material, tall oil, etc.

An advantage of the invention is that by supplying a dust-binding liquid or some other solution into the dust separator only at the time the separator is to be emptied, dust formation can be prevented exactly at the emptying phase and therefore a relatively small amount of liquid is needed for binding the dust. Consequently, a device which for practical reasons requires a fairly small container can carry out its drilling function even for a fairly long time without dust-related problems being caused. The fact that the dust has already been partly moistened with the liquid supplied together with the flushing air further reduces the amount of liquid needed in the dust separator.

BRIEF DESCRIPTION OF THE DRAWINGS

The invention will be illustrated in greater detail in the following drawings, in which.

DETAILED DESCRIPTION

Figure 1:
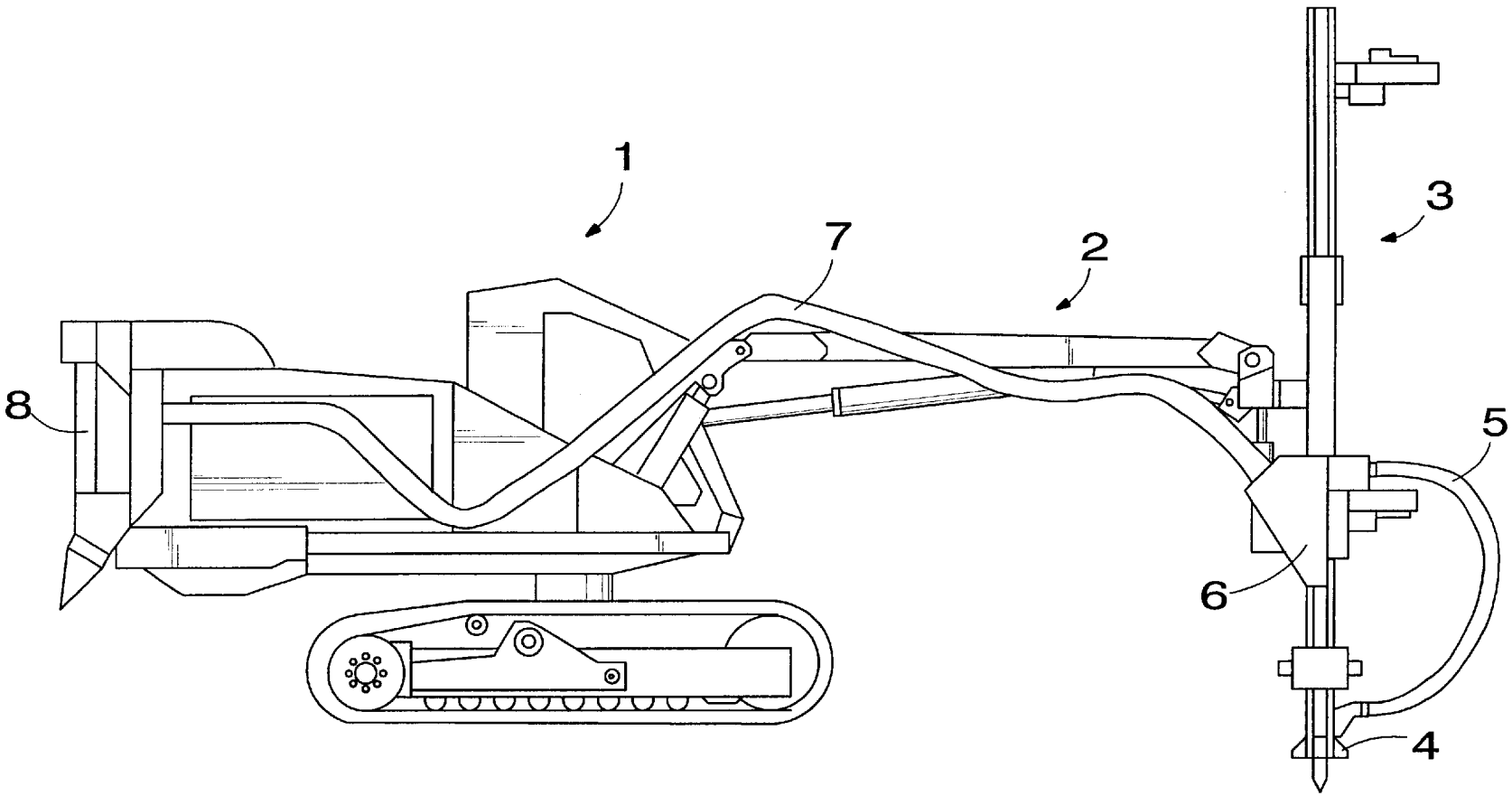
FIG. 1 is a schematic view of rock drilling equipment that can be used for implementing the invention and FIG. 2 is a schematic diagram of dust-binding equipment that can be used for implementing the invention.

FIG. 1 illustrates rock drilling equipment comprising a base 1 and a boom 2 attached thereto, both known per se. The end of the boom 2 is provided with a feed beam 3 and the associated rock drilling machine. The rock drilling equipment typically also comprises a compressor, not shown, for supplying compressed air through a drill rod to a drilling hole, whereby the air exiting through an annular space remaining between the drill rod and the drilled hole brings with it also drilling residuals, i.e. stone dust and material coarser than dust. The equipment and their operation are generally known in the art and apparent to a skilled person, therefore they do not need to be explained in greater detail in this context. The front end of the feed beam is provided with a suction nozzle 4 arranged around the drill rod in such a way that during the drilling it can be pressed tightly against the ground around the hole to be drilled. A suction hose 5 leads from the suction nozzle 4 to a pre-sorter 6 where the coarse material is separated from the dust. From the pre-sorter 6 the dust and the suction air continue further along a hose 7 to a dust separator 8 which is usually located at the rear portion of the rock drilling equipment. In the dust separator the dust is separated from the suction air and it accumulates into the dust separator 8. The dust accumulated into the dust separator 8 is removed therefrom at suitable intervals by discharging the accumulated dust onto the ground. The operation of the dust separator is described in greater detail in connection with FIG. 2.

Figure 2:
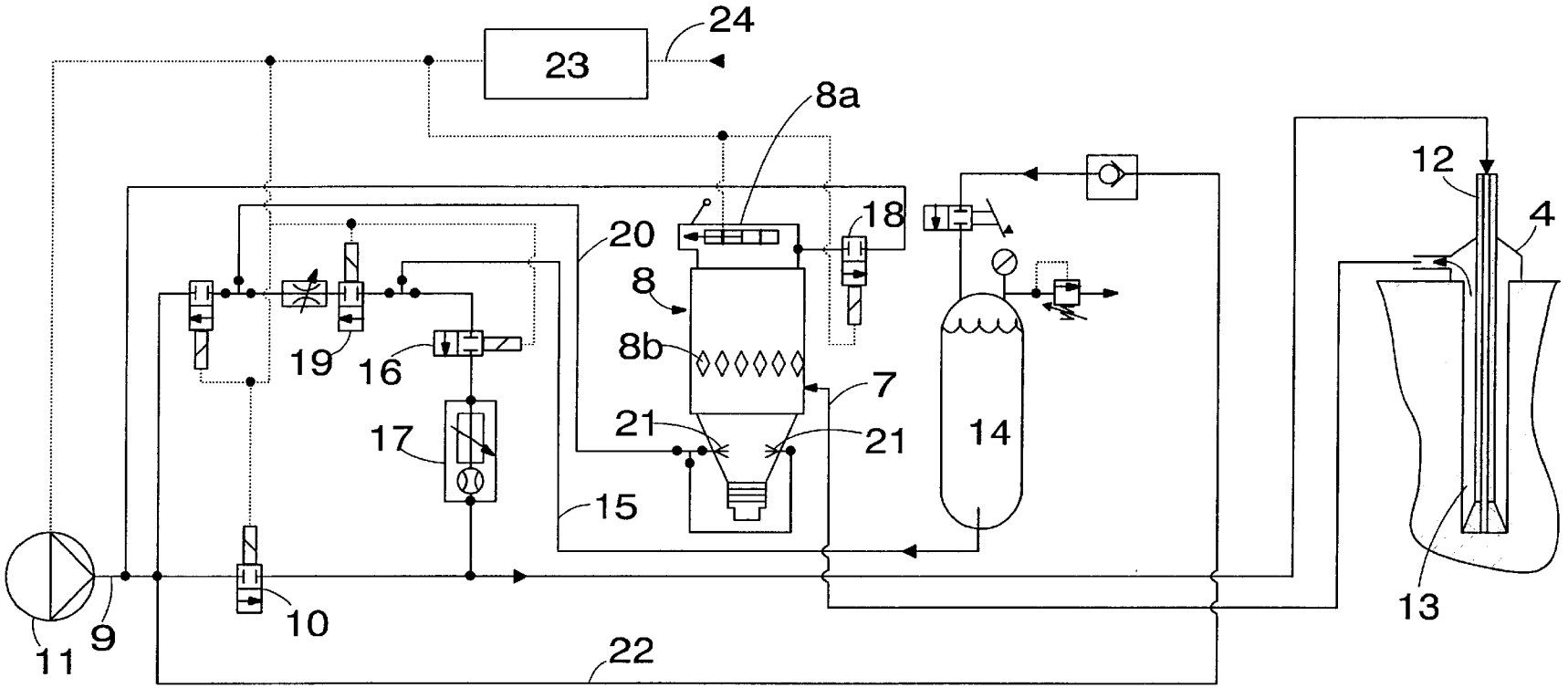

FIG. 2 is a schematic diagram of a dust-separating equipment suitable for implementing the invention. Dust-separating equipment and dust separators of this type are generally known per se and therefore they do not need to be described in greater detail in this context. FIG. 2 shows a flushing air duct 9 provided with a flushing valve 10. Air supplied through the flushing duct 9 by a compressor 11 controlled by the flushing valve 10 is supplied through the drill rod 12 into the drilling hole 13 to remove therefrom the drilling residuals formed during the drilling. At the same time, liquid contained in a liquid tank 14 is fed through a duct 15 controlled by a valve 16 into the flushing air. The amount of the liquid is controlled by a separate regulator 17, which allows the liquid to be mixed into the flushing air preferably in a mist-like form. The liquid carried within the flushing air moistens and thus binds most of the stone dust produced. The flushing air exiting from the drilling hole is sucked with a suction device 8*a* through the hose 5 into the pre-sorter 6 and further through the hose 7 into the dust separator 8. In the pre-sorter shown in FIG. 1, which is not necessary for the invention, the coarser material is separated from the flushing air and the dust-like material continues with the air further into the dust separator 8. In the dust separator 8 the dust accumulates into filters 8*b* at the same time as air flows through the filters 8*b* and out of the separator substantially without causing dust to spread. Portions of dust are then removed from the dust separator 8 at suitable intervals. To allow the dust to be removed, the dust separator 8 is connected to a compressed air duct 9 through a valve 18 arranged at the upper portion of the dust separator 8. When drilling is interrupted and suction air does not need to be sucked into the dust separator, the valve 18 is used for supplying a compressed air pulse into the dust separator 8, as a result of which the dust is detached from the filter and falls to the lower portion of the dust separator. Prior to the compressed air pulse and/or during it, a valve 19 is used for supplying liquid in a mist-like form or in very small droplets from the tank 14 through a duct 20 to the lower portion of the dust separator 8, through nozzles 21, or the like, arranged thereto. The liquid can be supplied using for example the solution shown in FIG. 2 where compressed air is supplied through a duct 22 to the upper portion of the liquid tank so that the liquid is forced out of the tank 14 by impact of the pressure caused by the compressed air. When necessary, the liquid can be fed both prior to the compressed air pulse and during it, i.e. in connection with the dust removal, substantially and immediately before the dust removal and/or for the entire duration of the dust removal. The dust falling from the filters 8*a* is moistened in the lower portion of the dust separator by the liquid supplied into it to such an extent that the dust discharged from the lower portion of the dust separator is in the form of a mass which does not create dust.

The supply of the liquid and the dust removal can be controlled by a separate control member 23 connected to control the above mentioned valves and the compressor as well as the suction device in the dust separator. The control member is most preferably connected through a control duct 24 to the actual drilling-control equipment known per se, the control member receiving a control signal through the control duct 24 on the basis of which the control member 23 either controls liquid to be supplied into the flushing air, when necessary, or into the dust separator for the duration of the dust removal. The control member 23 can be arranged to control the equipment in various ways. For example, the control may be based on switching the rock drilling machine to a return motion or on some other signal or detector detecting a specific drilling phase. The control member 23 may also be integrated into the actual drilling-control equipment, either as a unit clearly formed for this purpose or implemented by software, if the actual drilling-control equipment is a computer or a similar device.

The liquid used in this invention may be water, or water mixed with a suitable biologically degradable binding agent, which is preferably glue-like and/or reduces the surface tension of water. Examples of these include lignin-based materials and tall oil, which are both natural substances, provide suitable action and degrade biologically. The use of material such as this provides a further advantage in that the dust that falls onto the ground remains bound and dust-free from a few days to some weeks even, which ensures sufficiently long dust-free working conditions to allow the works to be completed. Other similar materials may also be used, although those readily available in the nature are of course the most advantageous for the environment. Moreover, material having corresponding biodegradable properties and reducing the surface tension of water when mixed with water may also be used. The properties of reducing surface tension of water and providing glue-like action may be found in one and the same material.

The timing of the dust removal and the supply of the liquid into the dust separator may be implemented according to various principles, provided that the basic idea of the invention is adhered to. There are different alternatives for timing the dust removal. The dust can be removed from the dust separator always after a completed drilling of a hole, after a pre-determined drilling time, after a pre-determined number of holes have been drilled, etc. The dust may be removed either when the drilling is interrupted or during the return motion of the drilling machine, or at some other suitable phase where flushing air does not need to be supplied into the drilling hole. A significant and preferred aspect in the removal and binding of the dust is that, irrespective of the timing of the dust removal operation with regard to the drilling phases, the moistening liquid is supplied into the lower portion of the dust separator only in connection with the dust removal, thereby allowing for a sufficient moistening of the dust to be removed, but avoiding unnecessary extra consumption of water that would cause costs and extra work.

The above specification and the related drawings only describe the invention by way of example, the invention being in no way restricted to it. An preferred aspect is that liquid is supplied into the drilling hole together with flushing air to partially moisten the dust already in advance, and, in addition, more liquid is added into the dust separator only in connection with the dust removal, the liquid containing preferably a lignin-based material, tall oil or some other biodegradable material that has glue-like properties and/or those reducing surface tension, which allows the dust to be removed from the dust separator in the form of particles that stick together.

What is claimed is:

1. A method for reducing dust-related problems in rock drilling, comprising:

supplying air and liquid mist into a drilling hole to moisten dust that comes off the drilling hole;

leading the air and moistened dust exiting from the drilling hole to a dust separator for separating the dust from the air by leading the air through at least one filter;

removing dust portions that collect in the dust separator at suitable intervals; and at least when dust is to be removed from the dust separator, supplying liquid in at least one of a form of a mist and as small droplets substantially only to a lower portion of the dust separator below the at least one filter so that the dust portion removed from the dust separator is moist.

2. A method according to claim 1, wherein liquid is supplied into the lower portion of the dust separator immediately before the dust portion is to be removed from the dust separator.

3. A method according to claim 2, wherein liquid is supplied for an entire duration of the removing step.

4. A method according to claim 1, wherein the liquid used is water mixed with biologically rapidly degradable binding agent.

5. A method according to claim 4, wherein at least some of the binding agent is a lignin-based material.

6. A method according to claim 4, wherein at least some of the binding agent is tall oil.

7. A method according to claim 4, wherein the binding agent reduces the surface tension of water.

8. A method according to claim 4, wherein the binding agent has glue-like properties.

9. A method according to claim 1, wherein the supply of liquid is arranged to take place automatically during a predetermined drilling phase.

10. An arrangement for reducing dust-related problems in rock drilling, the arrangement comprising:

means for supplying flushing air and liquid into a drilling hole;

suction means for sucking air containing stone dust and exiting from the drilling hole;

a dust separator for separating the stone dust from the air containing stone dust;

means for removing dust that accumulates from the dust separator;

means for supplying liquid in a form of at least one of a mist and small droplets into a lower portion of the dust separator for moistening the acumulated dust at least when the dust is being removed from the dust separator by the removing means; and a liquid container for storing liquid to be used for moistening the dust.

11. An arrangement according to claim 10, further comprising a control member for controlling the supply of liquid so that liquid is supplied into the lower portion of the dust separator before the removal of the dust from the dust separator.

12. An arrangement according to claim 11, wherein the control member is arranged to supply liquid to the lower portion of the dust separator substantially for an entire duration of dust removal by the removal means.

13. An arrangement according to claim 11, wherein the control member is arranged to supply liquid automatically during a specific, predetermined drilling phase.

* * * * *